US006029557A

United States Patent [19]

Sulm et al.

[11] Patent Number: 6,029,557

[45] Date of Patent: Feb. 29, 2000

[54] APPARATUS FOR FEEDING BELTED AMMUNITION

[75] Inventors: Gunter Sulm, Vienna; Karl Brichta, Ebergassing, both of Austria

[73] Assignee: Steyr-Daimler-Puch Aktiengesellschaft, Vienna, Austria

[21] Appl. No.: 09/179,496

[22] Filed: Oct. 27, 1998

[30] Foreign Application Priority Data

Oct. 29, 1997 [AT] Austria ..... 1828/97

[51] Int. Cl.[7] ..... F41A 9/30

[52] U.S. Cl. ..... 89/33.14; 89/33.25

[58] Field of Search ..... 89/33.04, 33.16, 89/33.17, 33.25, 33.5

[56] References Cited

U.S. PATENT DOCUMENTS

| | | | |
|---|---|---|---|
| 2,342,065 | 2/1944 | Trotter et al. | 89/33.5 |
| 2,524,132 | 10/1950 | Naugler et al. | 89/33.17 |
| 2,719,459 | 10/1955 | Peterson | 89/33.5 |
| 5,107,750 | 4/1992 | Buchstaller et al. | 89/33.17 |

FOREIGN PATENT DOCUMENTS

| | | | |
|---|---|---|---|
| 128162 | 7/1948 | Australia | 89/33.16 |
| 907969 | 3/1946 | France | 89/33.17 |
| 2011236 | 9/1971 | Germany . | |
| 2430002 | 1/1976 | Germany | 89/33.25 |

*Primary Examiner*—Stephen M. Johnson
*Attorney, Agent, or Firm*—Bacham & LaPointe, P.C.

[57] ABSTRACT

A physically economic apparatus which is insensitive to defects for feeding belted ammunition by means of star-wheels is driven by a spring energy store which comprises a helical spring and a closed chain loop. The chain loop is formed by four sprocket wheels which are mounted in a housing and one of which is connected for drive purposes to the starwheel shaft. One end of the helical springs is supported on shoulders in the housing, and the other end is supported on pressure pieces which are fitted to the chain loop.

8 Claims, 2 Drawing Sheets

APPARATUS FOR FEEDING BELTED AMMUNITION

BACKGROUND OF THE INVENTION

The present invention relates to an apparatus for feeding belted ammunition to an automatic firearm by means of starwheels which are arranged in front of the weapon on a starwheel shaft. The weapon generally also has an integrated belt feeder, and the starwheels are used to pull the belt out of a magazine. To this end, they have to exert forces of variable magnitude, accelerate quickly from rest, and must not be driven at a fixed speed, in order to avoid necessitating synchronization with the weapon.

For this reason, powerful external drives with a complex control system are normal for heavy automatic firearms. According to DE 20 11 236 C2, torque measurement and a controllable coupling are required for this purpose. Apart from the space requirement, susceptibility to defects is critical in a combat vehicle.

SUMMARY OF THE INVENTION

It is thus an aim of the present invention to propose a feed apparatus which is physically as economical as possible and is as insensitive as possible to defects. This is achieved according to the invention in that the starwheel shaft is driven by a spring energy store which comprises a helical spring used as a compression spring, and a closed chain loop.

The high energy density (stored energy relating to the space requirement) of a helical spring and the small space requirement for a chain result in very small installation dimensions and, owing to the chain loop, the output drive is very simple, since it transmits the force itself. The helical spring in conjunction with the simple force transmission allows the necessary high acceleration. The use of the helical spring as a compression spring has the advantage that the spring can still exert force even if it breaks. Furthermore, no control system is necessary since the spring matches the force required.

In one advantageous configuration, the chain loop is formed by at least two sprocket wheels which are mounted in a housing and one of which is connected for drive purposes to the starwheel shaft, and one end of a helical spring is supported in the housing, and the other end is supported on a pressure piece which is fitted on the chain. One of the sprocket wheels, which are required for stressing and guiding the chain loop, is thus at the same time used as an output drive element. The connection between the helical spring and the chain via the pressure piece is particularly simple and in addition easily adjustable.

In a preferred development, two helical springs are provided in the housing, which helical springs are arranged parallel and are supported at opposite ends on shoulders in the housing. This duplication means that the two springs are connected in parallel, as a result of which they may be of smaller size for the same force requirement. This then results in no additional space requirement and improves the reliability.

A further configuration consists in that 4 sprocket wheels are provided, two on each of the two ends of the spring energy store. In consequence, instead of a sprocket wheel whose size matches the given distance between the two runs of the chain loop on each side, it is possible to use two small sprocket wheels. This further reduces the space requirement and allows a higher step-up ratio in the starwheel shaft drive.

Alternatively or cumulatively, the sprocket wheel which is connected for drive purposes to the starwheel shaft can also be seated, in order to select an optimum step-up ratio, on a sprocket wheel shaft which drives the starwheel shaft via a connecting shaft and a step-up gearbox. Thanks to the connecting shaft, the step-up gearbox is arranged in a physically economic manner on the side of the starwheel shaft facing away from the spring energy store.

Finally, it is also practical for the starwheel shaft to have, on the end facing away from the step-up gearbox, a coupling part for an external pulling apparatus, so that it is easily accessible.

BRIEF DESCRIPTION OF THE DRAWINGS

The invention is described and explained in the following text with reference to illustrations of an exemplary embodiment, in which.

DETAILED DESCRIPTION

Figure 1:
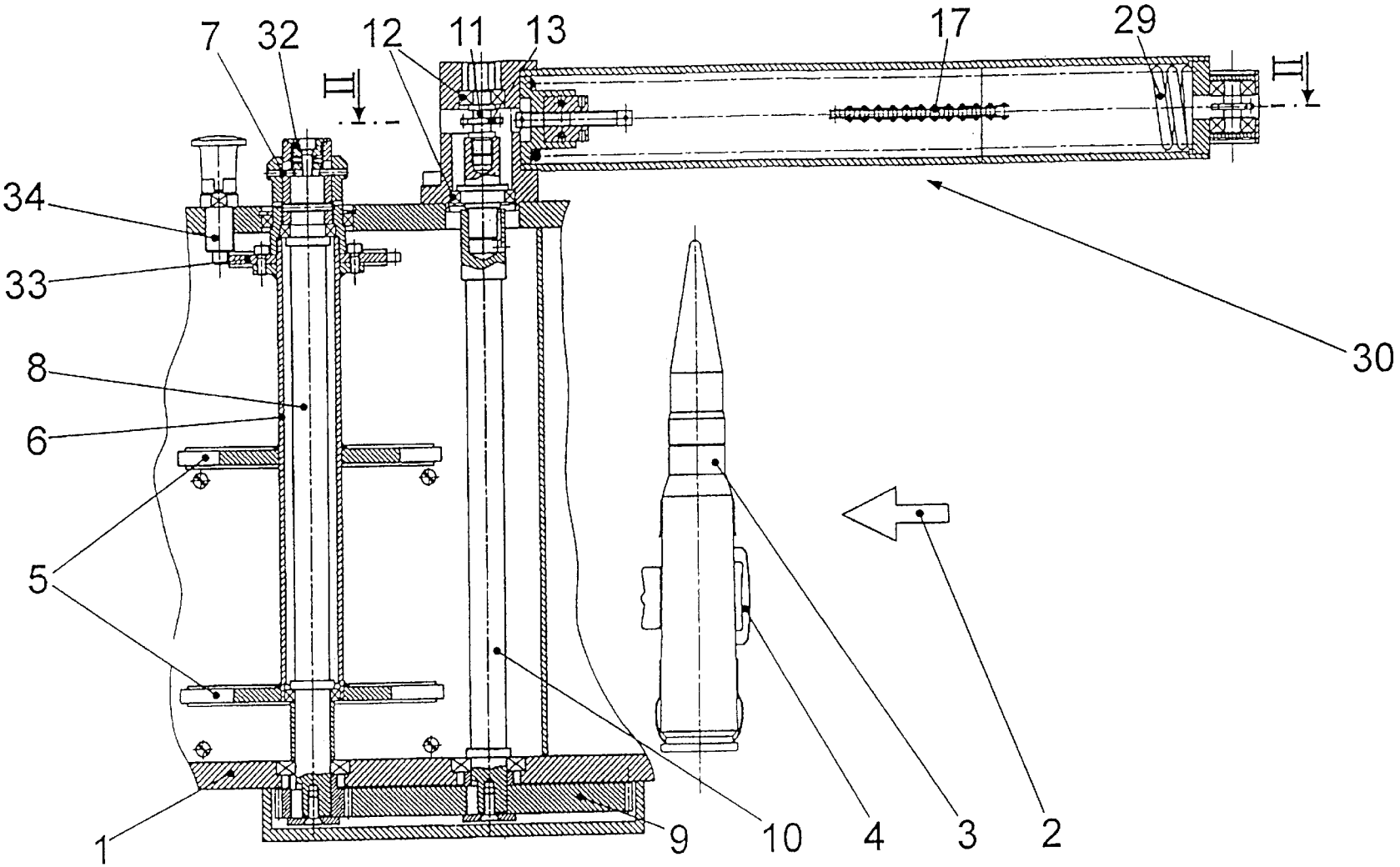
FIG. 1—shows a plan view of an apparatus according to the invention.

In FIG. 1, 1 denotes a frame of the apparatus according to the invention or a magazine wall, depending on the installation and application of the apparatus. The pulling-in direction is indicated by an arrow 2, and the belted ammunition to be pulled in is indicated by a cartridge 3 with a part of the belt 4. Starwheels 5, which engage in the intermediate spaces between the cartridges, are mounted on a drum 6 which is mounted in the frame 1. The drum 6 is connected for drive purposes via a weak-bolt coupling 7 to a starwheel shaft 8, which is mounted in the starwheel drum 6. A step-up gearbox 9 is arranged at the end of the starwheel shaft 8 opposite the weak-bolt coupling 7, comprises a pair of toothed wheels, and is driven by a connecting shaft 10 which, for its part, is connected for drive purposes to a coaxial sprocket wheel shaft 11. The sprocket wheel shaft 11 is mounted between two bearings 12, and a first sprocket wheel 13 is fitted to it, in the center between the bearings 12.

Figure 2:
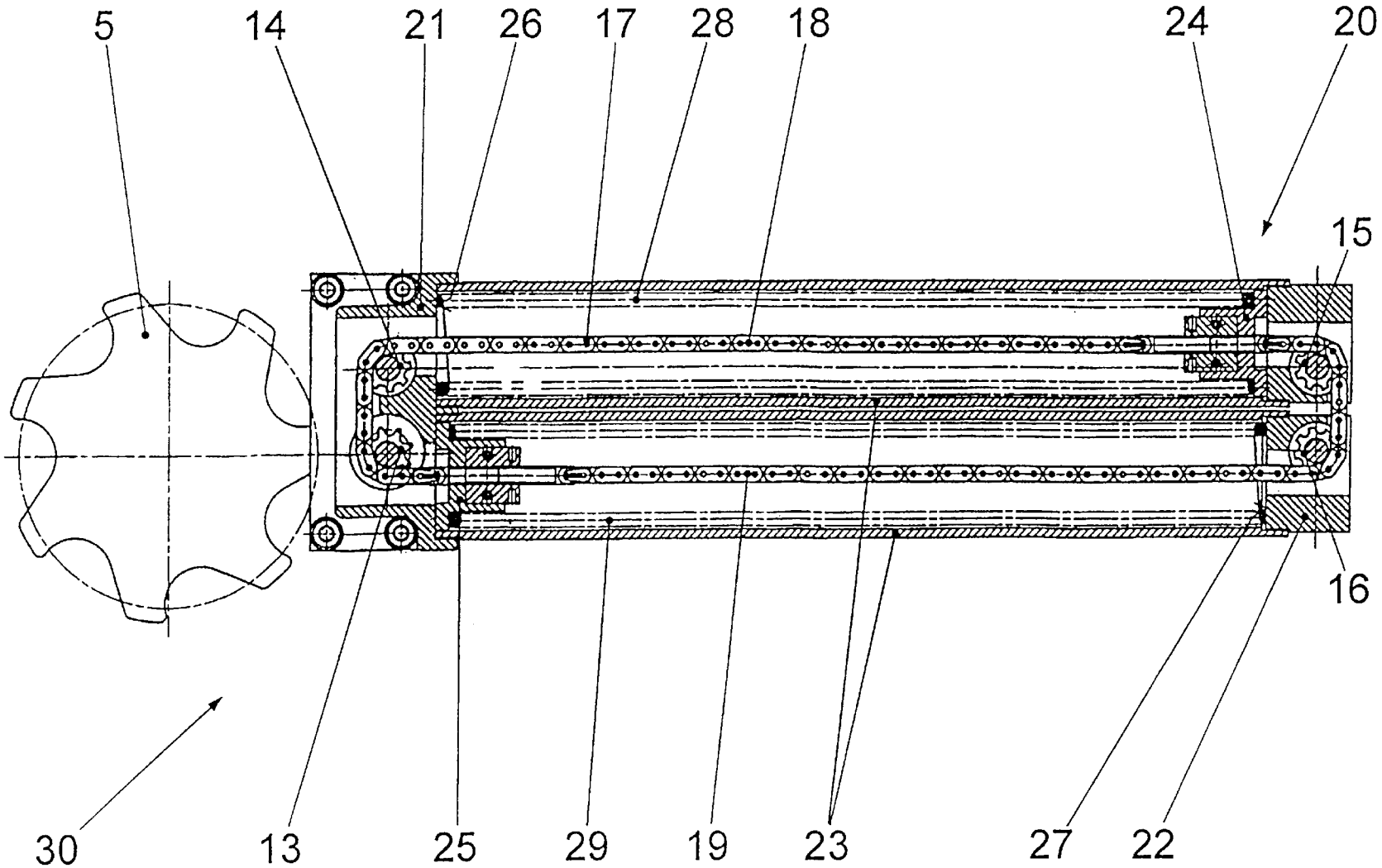
FIG. 2—shows a section along II—II in FIG. 1.

The first sprocket wheel produces the connection to a spring energy store 30, whose configuration can be seen better in FIG. 2. The first sprocket wheel 13 as well as a second, third and fourth sprocket wheel 14, 15, 16, are surrounded by a closed chain loop 17, which forms a first run 18 and a second run 19. The chain is preferably a conventional chain formed by links, as is used for driving two-wheeled vehicles. Sprocket wheels 13, 14, 15, 16 and the chain loop 17 are located in a housing 20 of the spring energy store 30, which comprises a first end block 21, that is screwed to the frame 1, a second end block 22 and sheathing tubes 23 which connect the two end blocks 21, 22. The sprocket wheels 13, 14, 15, 16 are also mounted in one of the end blocks 21, 22 (on either end of the spring energy store 30) such that they can rotate.

A first pressure piece 24 and a second pressure piece 25 are mounted on the two runs 18, 19 of the chain loop 17. On the sides facing the sheathing tubes 23, the two end blocks 21, 22 form shoulders 26, 27. A first spiral spring 28 is arranged between the shoulder 26 of the first end block 21 and the first pressure piece 24; a second spiral spring 29 is arranged between the second shoulder 27 of the second end block 22 and the second pressure piece 25. In the unstressed state, the pressure pieces 24, 25 are at opposite ends of the sheathing tubes 23, corresponding to the opposite movement direction of the two runs 18, 19.

The two spiral springs 28, 29 are thus used in parallel and as compression springs. In order to load the spring energy store, the spiral springs 28, 29 are stressed by an external apparatus which is not illustrated—in the simplest case this is a hand crank. For this purpose, a coupling part 32 is provided, for example, on the starwheel shaft 8, but this could, alternatively, be arranged on the sprocket wheel shaft 11 or could even be designed as a freewheeling mechanism. When the spring energy store is loaded, the pressure pieces 24, 25 are located (FIG. 2) approximately in the center of the sheathing tubes 23. In order to lock the energy store in the cocked position, a locking wheel 33 can be provided on the starwheel drum, in which a locking bolt 34, which is fixed to the frame, engages.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for feeding belted ammunition to an automatic firearm by means of starwheels which are arranged in front of the firearm on a starwheel shaft, the improvement comprising the starwheel shaft for feeding said ammunition is driven by a spring energy store which comprises a helical spring under compression and a closed chain loop.

2. The apparatus for feeding belted ammunition as claimed in claim 1, wherein the chain loop is formed by at least two sprocket wheels which are mounted in a housing, one sprocket wheel is connected for drive to the starwheel shaft, and wherein one end of the helical spring is supported on shoulders in the housing and the other end is supported on a pressure piece which is fitted on the chain loop.

3. The apparatus for feeding belted ammunition as claimed in claim 2, wherein two helical springs are provided in the housing, said helical springs are arranged parallel and are supported on opposite shoulders in the housing.

4. The apparatus for feeding belted ammunition as claimed in claim 2, wherein four sprocket wheels are provided, two on each end of the spring energy store.

5. The apparatus for feeding belted ammunition as claimed in claim 2, wherein the sprocket wheel which is connected for drive purposes to the starwheel shaft is seated on a sprocket wheel shaft which drives the starwheel shaft via a connecting shaft and a step-up gearbox.

6. The apparatus for feeding belted ammunition as claimed in claim 5, wherein the starwheel shaft has, on the end facing away from the step-up gearbox, a coupling part for an external pulling apparatus.

7. An apparatus for feeding belted ammunition to an automatic firearm by means of starwheels which are arranged in front of the firearm on a starwheel shaft, the improvement comprising the starwheel shaft is driven by a spring energy store which comprises a helical spring under compression and a closed chain loop wherein the closed chain loop is formed on sprocket means.

8. An apparatus for feeding belted ammunition to an automatic firearm by means of starwheels which are arranged in front of the firearm on a starwheel shaft, the improvement comprising the starwheel shaft has an axis substantially parallel to said belted ammunition and is driven by a spring energy store which comprises a helical spring under compression and a closed chain loop.

* * * * *